United States Patent [19]

Pohl

[11] Patent Number: 5,026,436

[45] Date of Patent: Jun. 25, 1991

[54] PROCESS FOR THE PRODUCTION OF TUBULAR BODIES

[75] Inventor: Helmut Pohl, Neunkirchen, Austria

[73] Assignee: Schoeller-Bleckmann Gesellschaft m.b.H., Ternitz, Austria

[21] Appl. No.: 388,868

[22] Filed: Aug. 3, 1989

[30] Foreign Application Priority Data

Aug. 4, 1988 [AT] Austria ..... 1965/88

[51] Int. Cl.[5] ..... C21D 9/08; C21D 8/10

[52] U.S. Cl. ..... 148/12 B; 148/12 E; 148/12 R

[58] Field of Search ..... 148/12 B, 12 E, 12 R, 148/909, 12.4

[56] References Cited

U.S. PATENT DOCUMENTS 4,472,207 9/1984 Kinoshita et al. ..... 148/12 B 4,919,728 4/1990 Kohl et al. ..... 148/12 B

*Primary Examiner*—Deborah Yee

*Attorney, Agent, or Firm*—Cushman, Darby & Cushman

[57] ABSTRACT

In a process for the production of tubular bodies that are resistant to stress corrosion cracking, in particular non-magnetizable drill stems and rod sections of austenitic steels, after solution treatment, quenching, and after deformation at a temperature of under 500° C., in order to increase the mechanical properties of the material, and after processing and incorporation of a drilling, the body is heated to a temperature of 220° to 600° C., at least to temperature equalization with a temperature differential of at most 10° C. in the walls of the body. The body is then maintained for at most a time t in minutes at a temperature T in degrees Celsius in accordance with the expression $$t = 10^{-(T-638)/50}$$

after which it is cooled by the increased withdrawal of thermal energy, at least from the internal surface of the tubular body and the cooled surface exhibits a temperature drop of at least 100° C./min from the starting temperature to the half value between the starting temperature and room temperature.

10 Claims, 1 Drawing Sheet

PROCESS FOR THE PRODUCTION OF TUBULAR BODIES

Figure 1:
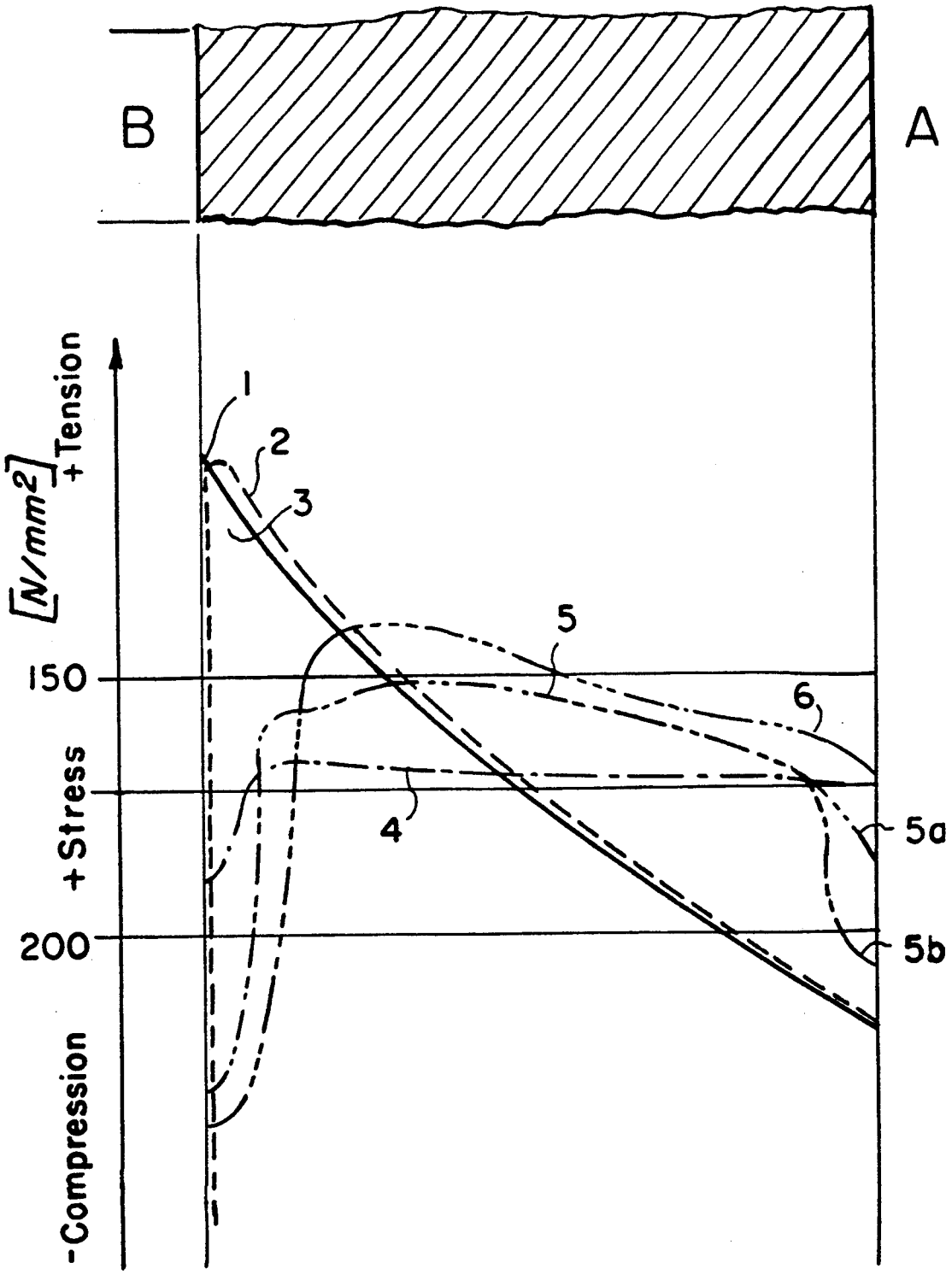

This invention relates to a process for the production of tubular bodies that are resistant to stress corrosion cracking, in particular non-magnetizable drill stems of austenitic steels and parts produced by this process.

Drill stems and rod sections of very high material strength are needed to weight and stabilize the boring head when driving a bore hole. In order to be able to monitor the progress of the bore hole as it is being driven, and to produce directional drillings, it is essential to measure the inclination and the direction of the bore hole frequently and at specific intervals, and to do this, preferably, on the basis of the Earth's magnetic field. In order that such measurements of the Earth's magnetic field can be made with sufficient accuracy, and are not unduly influenced by extraneous factors, drill rod sections that are totally non-magnetizable have to be used for this purpose. It is advantageous to use a process as set out in EU-PS 14 195 in order to check non-magnetizable drill stems.

Cu-Ni-Al alloys, the so-called Monel K alloys, are used exclusively for non-magnetisable stems, because such alloys are completely non-magnetic, possess the required mechanical properties, and are considered relatively easy to machine.

However, Monel K alloys are relatively costly, so that it has been proposed that austenitic steels be used for achieving economical products for the production of non-magnetisable drill stems and drill rod sections.

Conventional 18/8 CrNi steels display unfavourable magnetic behaviour and possess inadequate mechanical properties or low limits of ductility, and are difficult to machine, so that such materials are hardly suitable.

In order to eliminate this unsatisfactory situation, AT-PS 214 460 proposes that stable-austenitic steels, in particular manganese-austenite, be used for non-magnetisable drill stems; when this is done, the tube sections that are produced therefrom are to be hardened by a cold forming in order to arrive at high limits of ductility for the material. The properties of such drill stems meet the usual requirements. However, they entail the disadvantage that they are not always sufficiently resistant to corrosion attack, for example, by aggressive chloride solutions that are frequently present in bore holes, and are inclined to stress corrosion cracking. This can cause fractures that result in the failure of such drill stems.

In order to improve the corrosion behaviour, and in particular to avoid stress corrosion cracking, with good magnetic material properties, AT-PS 308 793 also proposes the production of drill stems and rod sections from alloys having a chromium content of 20 to 25%, nickel contents of 10 to 15%, and nitrogen contents of 0.05 to 0.5%; these being subjected to cold forming in order to increase mechanical properties.

The use of precipitation-hardened alloys with contents of approximately 33% Ni, 18% Cr, 2% Ti, 0.5% Al, and 0.004% N is also intended to result in significant improvements in the service properties of drill stems or drill-rod sections. The high content of costly alloying elements in these materials can result in economic disadvantages, however.

In order to exploit the economic advantages of producing drill stems from non-magnetisable and hardenable Cr-Mn steels, and to improve their corrosion behaviour, in particular their resistance to stress corrosion cracking, it has also been proposed (AT-PS 364 592) that residual compressive stresses be generated by the effects of mechanically released impact or compression energy in the surface area, in particular of the cavity, of the drill stems. It is preferred that air hammers are used to do this, the heads of such hammers incorporating a striker to transfer the axial striking movement. To a very large extent, drill stems produced in this way satisfy the demands that are made on them with regard to their properties for oil-field work. However, they have the disadvantage that residual compressive stresses that prevent stress corrosion cracking can be generated only to a slight depth beneath the surface. The main reason for this is that the tools used during surface hardening may only exert a limited amount of impact energy, and multiple impacts are to be avoided as much as possible, for otherwise the work of deformation of the steel will be exhausted in the working area of the striker and cracks will be formed. Because, on the one hand, the deformation of the zone that is close to the surface has to cover the surface, and on the other hand, and for the above reasons, repeated deformation entails disadvantages, the effect of the process is uncertain and difficult to monitor. Beneath a thin surface layer, in which there is a prodominance of compressive stresses, there are, however, zones with large tensile stresses, particularly in the cavity of the tubular part. Damage to the surface or the removal of small amounts of material can expose areas with tensile stresses, which can result in increased stress corrosion cracking. In addition, it is also a disadvantage that large areas of localized work hardening of the material, which are formed in the zone close to the surface by the mechanical application of compressive properties, increase the material's propensity for the formation of localized corrosion. When localized corrosion occurs, this undermines the layer of compressive stresses and increased stress corrosion cracking of the part occurs. The mechanical application of residual compressive stress in the surface layer of parts also entails the disadvantage that only simple shapes or contours can be appropriately treated, which means that this process must take place as the last stage of work, without any subsequent calibration. Thus, for all practical purposes, it is not possible to generate residual compressive stress in the surface zone on edges, in threaded parts, in corners, holes, and recesses, or on chamfers and parts with irregular surfaces, so as to prevent stress corrosion cracking.

Proceeding from this prior art, it is an object of the present invention to avoid the disadvantages set out above and to create a process for the production of tubular bodies that are resistant to stress corrosion cracking, in particular non-magnetizable drill stems and rod sections of austenitic steels. A further task of the present invention relates to tubular bodies that are resistant to stress corrosion cracking, in particular non-magnetizable drill stems and rod sections of austenitic steel that are produced by this process.

According to the present invention, this task has been solved in that after solution treatment, quenching, and after deformation at a temperature of under 500° C. in order to increase the mechanical properties of the material, and after processing and incorporation of a drilling, the body is heated to a temperature of 220° to 600° C., at least to temperature equalization with a temperature differential of at most 10° C. in the walls of the body; it is then maintained for at most a time t in minutes at a temperature T in degrees Celsius in accordance with the expression $$t=10^{-(T-638)/50}$$

after which it is cooled by the increased withdrawal of thermal energy, at least from the inside surface of the tubular body and the cooled surface exhibits a temperature drop of at least 100° C./min from the starting temperature to the half value between the starting temperature and room temperature. It is advantageous if the body is cooled from a starting temperature of 280° to 500° C., in particular from 300° to 400° C., with a temperature differential of at least 6° C., preferably at most 3° C., in the body walls. It is particularly advantageous if the inner surface and the outer surface of the tubular body are cooled, the inner cooling being effected at least 5 seconds, preferably 20 seconds earlier and/or at a greater intensity than the outer surface cooling.

According to the present invention, tubular bodies, in particular drill stems and rod sections of austenitic steel, which have been produced by this process, have local residual tensile stresses of less than 100 N/mm$^2$ to a depth of at least 8 mm in the zones that are contiguous to the surface. It is especially preferred if the zones contiguous to the surface have residual compressive forces to a depth of at least 4 mm, preferably of at least 8 mm, and that within the cross-section of the wall, the residual tensile forces that can occur are less than 150 N/mm$^2$, which is to say, are below the initiating stress for stress corrosion cracking, and are preferably less than 120 N/mm$^2$.

Because of a deformation of the blank at temperatures below 500° C., which serves to enhance strin hardening of the material or to increase the limits of ductility, tubular bodies, drill stems in particular, have considerable differences in the local residual stresses in the walls, for instance, compressive stresses on the outer surface, and elevated tensile stresses that are considerably above the limit for initiating stress corrosion cracking, on the surface of the cavity, which is to say, the drilling. Most surprisingly, it has been found that in a tubular body produced from solution treated, quenched and strain hardened austenitic material, by heating to appropriate temperatures whilst maintaining specific conditions, with subsequent intensified cooling, one can induce stress states that induce a residual-stress state because of plastic deformations in the tube wall, this state largely having no local tensile stresses that are above the limit at which stress corrosion cracking is initiated. In addition, by appropriate selection of the starting temperature and differing internal or external cooling in the wall of the tubular body, distributed in time and/or with regard to their intensity, one can produce a residual stress state in which compressive stresses are present in the areas close to the surface to a depth of 4 mm. Thus, most surprisingly, when the process according to the present invention is used, there is a shift of the residual stress in the wall without any concomitant degradation of the great strength or high limit of ductility of the material brought about by cold forming. It is important that the temperature differentials in the tube wall be slight after heating to the starting temperature, for otherwise the stress shift will be adversely affected during the intensive cooling, or can only be effected to a limited extent and a desired residual stress state cannot be achieved in a suitable manner. For this reason, the temperature differential in the wall should be kept smaller than 10° C. Longer holding times at the starting temperature have an undesirable effect because the solution treated, quenched, and cold formed steel, for example, austenitic Mn-Cr steel, is brought to a sensitized state for an intercrystalline crevice corrosion. It has been found that the sensitizing depends on diffusion and carbide-forming, and possibly nitride-forming, processes, the temperature (T) influences the holding time (t) until sensitization of the material logarithmically with the relationship $$T=-50 \log t+638$$

For this reason, the holding time at the starting temperature is to be selected so as to be smaller than the value that results from the following relationship:

$$t=10^{-(T-638)/50}$$

In addition, it is also important that the tubular body is cooled from the starting temperature by the increased removal of heat, at least from the inner wall, because the tensile stresses that originate from the cold forming or work hardening are to be displaced into the area of the inner surface of the wall. Insufficient displacement of residual stress will result from low cooling intensity, so that the cooled surface of the tube wall must experience a temperature drop from the starting temperature to the half value between the starting temperature and room temperature of at least 100° C./min.

It was most surprising that the process according to the present invention brought about a shift in the residual stress, and can be used for the production of tubular bodies that are resistant to stress corrosion cracking, in particular of non-magnetizable drill stems and rod sections of austenitic steels. When this was done, prejudice in professional circles has to be overcome, in that because of the heating to elevated starting temperatures, there was an unacceptable loss of strength or a reduction of the limit of ductility of the cold-formed material and lower starting temperatures can have no effect because only elastic material deformations take place during the subsequent cooling. In addition, experts assumed that the increased strength and the large tensile stresses on the inner surface of the tube cause cracks, particularly longitudinal cracks, even during the heating to the starting temperature. In particular, corrosion experts feared that repeated heating of material that had been quenched and work-hardened brings about sensitization that makes the material vulnerable, in media that contain chlorides, relative to the disintegration of the grain or the formation of intercrystalline cracks.

The invention will now be described in more detail, by way of example only, with reference to the accompanying drawings in which FIG. 1 is a diagram showing the stress states in the wall of a tubular body.

After work hardening by deformation of the tubular body at a temperature of below 500° C. there are residual stresses in the tubular body, these being compressive stresses on the outer wall A, and these become high tensile stresses towards the inner wall B, as indicated by the curve 1. During heating to a starting temperature of 200° C. with subsequent, intensive cooling of the inner wall of the tube, the tensile stresses that are present there are reduced only slightly, as is shown by the curve 3. The curves 4 and 5 shown the distribution of residual stresses in the tube wall during cooling from a starting temperature of 300° C. (4) and 400° C. (5). In the area of the outside wall A, the stress curve 5 is shown divided into part 5*a* when acted upon by air, and a part 5*b* when water acts on the outside surface. The displacement of the stress brought about by intensive cooling of the tube wall from temperatures of 300° C. and 400° C., for example, means that in the total tube wall the residual stresses are below 150 N/mm$^2$, namely, below the initiating stress for stress cracking corrosion, so that the body is completely resistant to stress cracking corrosion. In this instance, compressive stresses are achieved to a depth of greater than 4 mm on the inside surface.

An intensified cooling from a starting temperature of, for example, 550° C. increases the residual compressive stresses and their effective area on the inside surface of the tube wall (curve 6), which can be used during calibration that involves cutting operations. The curve 2 shows the shape of a curve in a tube wall that is adjustable by means of a process as described in AT-PS 364 592 or according to the prior art, respectively, there being a predominance of elevated residual compressive stresses on the inside surface, although these compressive stresses become elevated tensile stresses at a slight distance from the surface.

The present invention is explained in greater detail below on the basis of an example. A block of Mn-Cr-N steel, weighing approximately 3 t, composed of 0.05% C, 19.3% Mn, 13.6% Cr, 2.1% Ni, 0.23% N (in %-wt), the remainder being iron, was subjected to primary shaping by hot forging in a long forging machine to form a drill-stem blank with a diameter of 192×8800 mm. Quenching from a solution heat treatment temperature of 1020° C. was effected in a water basin. The blank was adjusted, cold forged with a degree of deformation of 15%, straightened, turned, and bored. The dimensions of the semi-finished product were as follows:

*AD* 0 172.3 × *ID* 0 70.45 × 9250 mm.
(*AD* = outer diameter, *ID* = inner diameter The residual stresses at AD O were −157 N/mm$^2$ (residual compressive stress) or at ID+390 N/mm$^2$ (residual tensile stress), the measured values representing the arithmetic mean value of three measurements with the ring-nucleus process.

A sample from one end of this semi-finished product was exposed to boiling, aqueous solution of saturated magnesium chloride (42%, 154° C.) for one day; after a short time, cracks formed, starting from the ID.

The tubular semi-finished product or the rod, respectively, (approximately 700 mm minimum length for the above sample) was heated to 415° C. in an electric furnace, when the temperature differential in the tube wall at the end of the heating period was 0.8° C. In a spray plant, this was followed first by jet cooling on the inside surface with a quantity of 1500 to 2500 l/min and after 10 to 30 seconds, preferably after 20 seconds, on the outside surface, too, with a quantity of cold water of approximately 100 l/min and a meter length, with a temperature drop on the surface of approximately 350° C., in any case to a temperature below 100° C.

As a result of this treatment, the residual stress status of the rod changed on the ID, from +390 N/mm$^2$ (tensile stress) to −410 N/mm$^2$ (compressive stress). A residual compressive stress of −120 N/mm$^2$ was also determined on the outside diameter. In addition, after turning and drilling, the residual stresses were identified through the thickness of the wall, the measured tensile stresses being smaller than 110 N/mm$^2$. A sample taken from this rod, which was tested in the above-described SCC test using magnesium chloride, remained totally crack-free.

A drill rod section was produced from this semi-finished product and additional samples were taken from this at locations that had been machined. An SCC test showed that recesses cut in the tube wall by milling, turning, and shaping, as well as NC-cut threads caused no cracks at all, this resulting from the non-critical residual stress status in the overall volume of the part.

The process according to the present invention is particularly advantageous for austenitic steels of a guide analysis C: max 0.25%-wt; Mn: 0 to 25%-wt; Cr: 12 to 30%-wt; Mo: 0 to 5%-wt; Ni: 0 to 75%-wt; N: 0 to 1%-wt; Ti: 0 to 3%-wt; Nb: 0 to 3%-wt; Cu: 0 to 3%-wt; remainder: iron.

Particularly preferred are Mn-Cr-austenite with 17 to 20%-wt Mn and 12 to 14%-wt Cr, and Cr-Ni-austenite with 17 to 24%-wt Cr and 10 to 20%-wt Ni.

The embodiments of the invention in which an exclusive property or privilege is claimed are defined as follows:

1. A process for the production of an austenitic steel tubular body that is resistant to stress corrosion cracking wherein after the steps of solution treatment, quenching, and deforming the body at a temperature under 500° C., in order to improve its mechanical properties, the tubular body is further processed by the steps of:

heating the body to a temperature of 220° to 600° C., at least to temperature equalization with a temperature differential of at most 10° C. in the walls of the body;

maintaining the body for at most a time t in minutes at a temperature T in degrees Celsius in accordance with the expression $$T = 10^{-(T-638)/50};$$

and cooling the body by the increased withdrawal of thermal energy, at least from the internal surface of the tubular body, wherein the cooled surface exhibits a temperature drop of at least 100° C./min from a starting temperature to a half value between the starting temperature and room temperature.

2. A process as claimed in claim 1, wherein the cooling step is performed at a starting temperature of 280° to 500° C. with a temperature differential in the wall of the body of at most 6° C.

3. A process as claimed in claim 1 or claim 2, wherein the cooling step is performed on the inner surface and the outer surface of the tubular body.

4. A process as claimed in claim 3, wherein the cooling of the inner surface of the tubular body is effected earlier and/or at a greater intensity than the cooling of the outer surface.

5. A process as claimed in claim 4, wherein the inner surface of the tubular body is cooled at least 5 seconds before the outer surface is cooled.

6. A process as claimed in claim 4, wherein the inner surface of the tubular body is cooled for at least 20 seconds before the outer surface is cooled.

7. A process as claimed in claim 3, wherein the cooling step is performed by gases and/or liquids as cooling agents.

8. A process as claimed in claim 3, further comprising the step of generating additional compressive stresses in the surface area of the body by mechanically initiating shock or compressive energy.

9. A process as claimed in claim 7, wherein the cooling step is performed by compressed air and/or water as cooling agents.

10. A process as claimed in claim 2, wherein the cooling step is performed at a starting temperature of 300° to 400° C., with a temperature differential in the wall of the body of at most 3° C.

* * * * *